US009273376B2

(12) United States Patent
Lutes et al.

(10) Patent No.: US 9,273,376 B2
(45) Date of Patent: Mar. 1, 2016

(54) FLUX INJECTION ASSEMBLY AND METHOD

(75) Inventors: Lennard Lutes, Copley, OH (US); Richard S. Henderson, Solon, OH (US); Jason Holstein, Solon, OH (US)

(73) Assignee: PYROTEK INC., Solon, OH (US)

( * ) Notice: Subject to any disclaimer, the term of this patent is extended or adjusted under 35 U.S.C. 154(b) by 157 days.

(21) Appl. No.: 14/118,482

(22) PCT Filed: Jun. 7, 2012

(86) PCT No.: PCT/US2012/041209

§ 371 (c)(1), (2), (4) Date: Nov. 18, 2013

(87) PCT Pub. No.: WO2012/170604

PCT Pub. Date: Dec. 13, 2012

(65) Prior Publication Data

US 2014/0083253 A1 Mar. 27, 2014

Related U.S. Application Data

(60) Provisional application No. 61/494,127, filed on Jun. 7, 2011.

(51) Int. Cl.
*C22B 21/00* (2006.01)
*C22B 9/10* (2006.01)
(Continued)

(52) U.S. Cl.
CPC ..... *C22B 21/062* (2013.01); *C22B 9/05* (2013.01); *C22B 9/10* (2013.01); *C22B 9/103* (2013.01); *C22B 21/068* (2013.01); *F27D 3/0025* (2013.01); *F27D 3/0026* (2013.01)

(58) Field of Classification Search
CPC ..... C22B 21/062; C22B 21/068; C22B 9/10; C22B 9/103; C22B 9/05; F27D 3/0025; F27D 3/0026
See application file for complete search history.

(56) References Cited

U.S. PATENT DOCUMENTS 4,913,735 A 4/1990 Palmer
5,304,771 A 4/1994 Griffin
(Continued)

FOREIGN PATENT DOCUMENTS

CN 2088108 U 11/1991
EP 1462530 A1 * 9/2004 ..... C22B 9/10
(Continued)

OTHER PUBLICATIONS

An, B D et al. KR 2011042556 published Apr. 2011. Human Translation.*
(Continued)

*Primary Examiner* — George Wyszomierski
*Assistant Examiner* — Tima M McGuthry Banks
(74) *Attorney, Agent, or Firm* — Fay Sharpe LLP

(57) ABSTRACT

A flux injector apparatus and method adapted to distribute a predetermined amount of flux to an associated pool of molten aluminum. The flux injector apparatus includes a pressurized tank adapted to store and feed the flux under pressure. A feed mechanism operative to discharge a predetermined amount of flux to an outlet and a controller for monitoring and operating the apparatus. The feed mechanism includes a housing having an inner wall defining a cavity with an inlet and an outlet. A feed wheel is positioned within the cavity and operative to receive a predetermined amount of flux from the inlet, translate the flux within the cavity and discharge the predetermined amount of flux through the outlet of the pressurized tank.

19 Claims, 8 Drawing Sheets

(51) Int. Cl.

| | |
|---|---|
| ***C22B 9/05*** | (2006.01) |
| ***F27D 3/00*** | (2006.01) |
| ***C22B 21/06*** | (2006.01) |

(56) References Cited

U.S. PATENT DOCUMENTS

| | | | | |
|---|---|---|---|---|
| 5,462,580 | A | 10/1995 | Eckert | |
| 6,162,279 | A | 12/2000 | Eckert | |
| 2008/0202290 | A1 * | 8/2008 | Chesonis et al. | 75/602 |
| 2008/0307927 | A1 | 12/2008 | Dupuis | |
| 2010/0052227 | A1 | 3/2010 | Neff | |
| 2010/0101371 | A1 * | 4/2010 | Schmeisser | 75/602 |

FOREIGN PATENT DOCUMENTS

| | | | | |
|---|---|---|---|---|
| GB | 2256427 | A * | 12/1992 | B65D 88/54 |
| JP | H0867923 | A | 3/1996 | |
| JP | 2004292941 | A * | 10/2004 | C22B 9/05 |
| KR | 2011042556 | A * | 4/2011 | |

OTHER PUBLICATIONS

European Patent App. No. 12796442.7, Extended European Search Report dated Feb. 9, 2015, 7 pp.

* cited by examiner

FLUX INJECTION ASSEMBLY AND METHOD

This application is a national stage of PCT/US12/41209 filed Jun. 7, 2012, which claims benefit of U.S. Provisional Application 61/494,127 filed Jun. 7,2011.

BACKGROUND

The present exemplary embodiment relates to an apparatus and method for introducing a refining agent into molten metal. It finds particular application in conjunction with a system for introducing a predetermined amount of chloride flux into a trough of molten aluminum, and will be described with particular reference thereto. However, it is to be appreciated that the present exemplary embodiment is also amenable to other like applications.

Molten metals such as aluminum are known to include high levels of oxide and/or nitride debris that have a negative effect on the solidification of the particular alloy. The melted or liquefied form of aluminum also attracts the formation and absorption of hydrogen within the molten aluminum. Hydrogen evolves as porosity during the solidification of aluminum alloys and is detrimental to the mechanical properties of the solid alloy. Degassing is an effective way of reducing hydrogen caused porosity.

One example of degassing involves introducing a mixture of an inert gas such as argon or nitrogen with a reactive gas such as chlorine or sulfur hepa-fluoride into the molten aluminum to collect hydrogen and de-wet solid impurities. The gas mixture bubbles to the surface with the hydrogen and oxide impurities.

However, these materials are highly noxious and can cause harmful effluent bi-products. Improper use of these gasses creates environmental problems. Accordingly, there is significant governmental regulation. The proper storage, transport and use of these gasses is burdensome and expensive due to its harmful effects and the associated federal regulations.

Molten aluminum can also be subject to a flux degassing process. Flux degassing is the process of introducing a powdered or granulated salt mixture such as chloride and/or fluoride into the molten aluminum via a carrier gas such as nitrogen or argon. The salt flux can be introduced by a rotary degassing apparatus. An exemplary rotary apparatus includes a central hollow shaft attached to a rotor inserted into a pool of molten aluminum and rotated such that the salt flux travels down the hollow shaft and is dispersed within the molten aluminum through apertures in the rotor.

There remains a need to provide an apparatus and method to efficiently and safely handle the injection of a predetermined amount of degassing flux into the molten metal.

BRIEF DESCRIPTION

In one embodiment, the present disclosure relates to a flux injector apparatus adapted to distribute a predetermined amount of flux to an associated pool of molten aluminum. The flux injector apparatus comprises a pressurized tank adapted to store and feed the flux under pressure. A feed mechanism operative to discharge a predetermined amount of flux to an outlet of the pressurized tank and a controller for monitoring and operating the apparatus. The feed mechanism includes a housing having an inner wall defining a cavity with an inlet and an outlet. A feed wheel is positioned within the cavity and operative to receive a predetermined amount of flux from the inlet, translate the flux within the cavity and discharge the predetermined amount of flux through the outlet of the pressurized tank.

In another embodiment, a method of distributing a predetermined amount of flux to an associated pool of molten aluminum is provided. The method includes providing a continuous amount flux to an inlet of a feed mechanism. A predetermined amount of flux is received by at least one notch of a feed wheel in the feed mechanism. The flux is translated to an outlet of the feed mechanism. Inert gas is mixed with the predetermined amount of flux and the flux and inert gas mixture is introduced into a pool of molten aluminum.

According to a further embodiment of the present disclosure, a flux injector apparatus for distributing flux to a pool of molten metal is provided. The assembly includes a feed mechanism within a pressurized tank. The tank is adapted to store and introduce flux to an inlet of the feed mechanism. The feed mechanism includes a feed wheel within a cavity of a housing having an inlet and an outlet. The feed wheel includes a plurality of notches in selective rotational alignment with the inlet and the outlet for receiving a predetermined amount of flux through the inlet and discharging the flux through the outlet. The inlet of the feed mechanism has an undercut portion at a leading edge to prevent blockage. The outlet of the feed mechanism is aligned with an outlet of the pressurized tank and adapted to be introduced to an associated pool of molten metal.

One advantage of the present disclosure is an assembly and method of use for a flux injector apparatus to provide a precise amount of flux to a pool of molten aluminum. Another advantage of the present disclosure is an assembly and method that safely stores and measures flux to prevent an overflow of flux provided to the pool of molten aluminum. The assembly also prevents flux overflow and environmental contamination. Yet another advantage of the present disclosure is a mechanism to maintain pressurized gas flow to the hollow shaft while isolating the pressurized tank.

DETAILED DESCRIPTION

It is to be understood that the detailed figures are for purposes of illustrating the exemplary embodiments only and are not intended to be limiting. Additionally, it will be appreciated that the drawings are not to scale and that portions of certain elements may be exaggerated for the purpose of clarity and ease of illustration.

Figure 1:
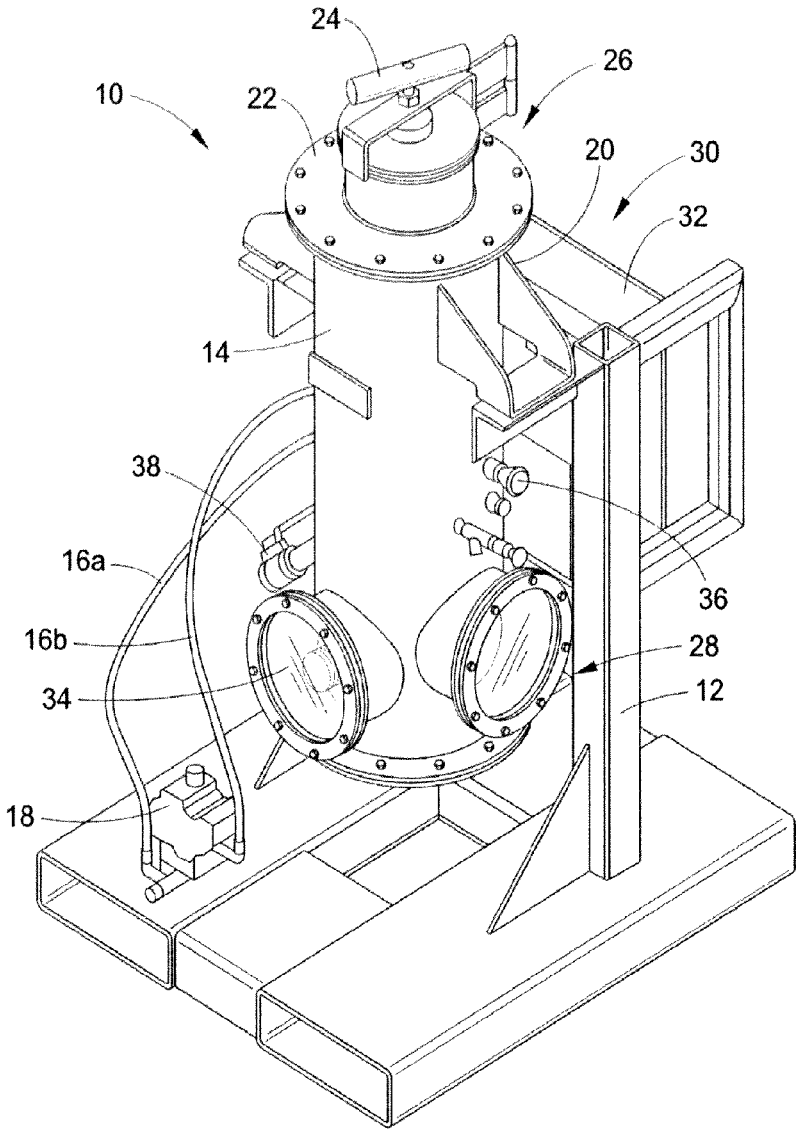
FIG. 1 is perspective view of the flux injector assembly in accordance with the present disclosure.

With reference to FIG. 1, a flux injector assembly 10 is supported by a structural base 12 that maintains the flux injector assembly 10 in an upright position. As used herein, the term "flux" is used to refer to a granulated particulate. An exemplary grain size ranges between about 1 mm to about 3 mm. The flux injector assembly 10 includes a pressurized tank 14 in communication with an isolation mechanism 18. In one embodiment, the isolation mechanism 18 is secured to the structural base 12 and configured to isolate the tank 14 from a flow of independent direct inert gas flow to a hollow shaft of a rotary apparatus (not shown). Moreover, mechanism 18 includes a pneumatic valve to control pressure within the tank 14 and prevent molten liquid backflow from entering the hollow shaft.

The pressurized tank is a generally sealed enclosure with cylindrical body 20 having an opening 22 closed via a secured cap 24 at a first end 26 and a second end 28 that is oppositely disposed from the first end 26. In one embodiment, the opening 22 is configured to receive flux and includes a screen to prevent foreign material or clumps of flux from entering the tank 14. The pressurized tank 14 is adapted to store an amount of flux under a controlled pressure. A controller 30 such as a programmable logic controller (PLC) based electric and gas control panel is provided in an enclosure 32. In one embodiment, the controller 30 is mounted to the structural base 12. However, the controller 30 can be provided at a location remote from the structural base 12.

The pressurized tank 14 can be provided with at least one sight window 34 on the cylindrical body 20 for visual verification of the internal operation of the assembly 10. More particularly, the sight window 34 allows a user to inspect the flow of flux therein and to identify properly working components within the tank 14. In one embodiment, the pressurized tank 14 is designed to operate at a threshold pressure of less than fifteen (15) pounds per square inch gauge (psig). In another embodiment the pressurized tank 14 is operated at a working pressure between two (2) psig and ten (10) psig. The pressurized tank 14 includes redundant pressure relief valves 36 to prevent an unwanted level of pressurization. A tank drain 38 is also provided for emptying or cleaning the assembly 10. In one embodiment, the tank is constructed with a powder coated material to prevent corrosion and clogging due to the interaction of flux and other chemicals.

Figure 2:
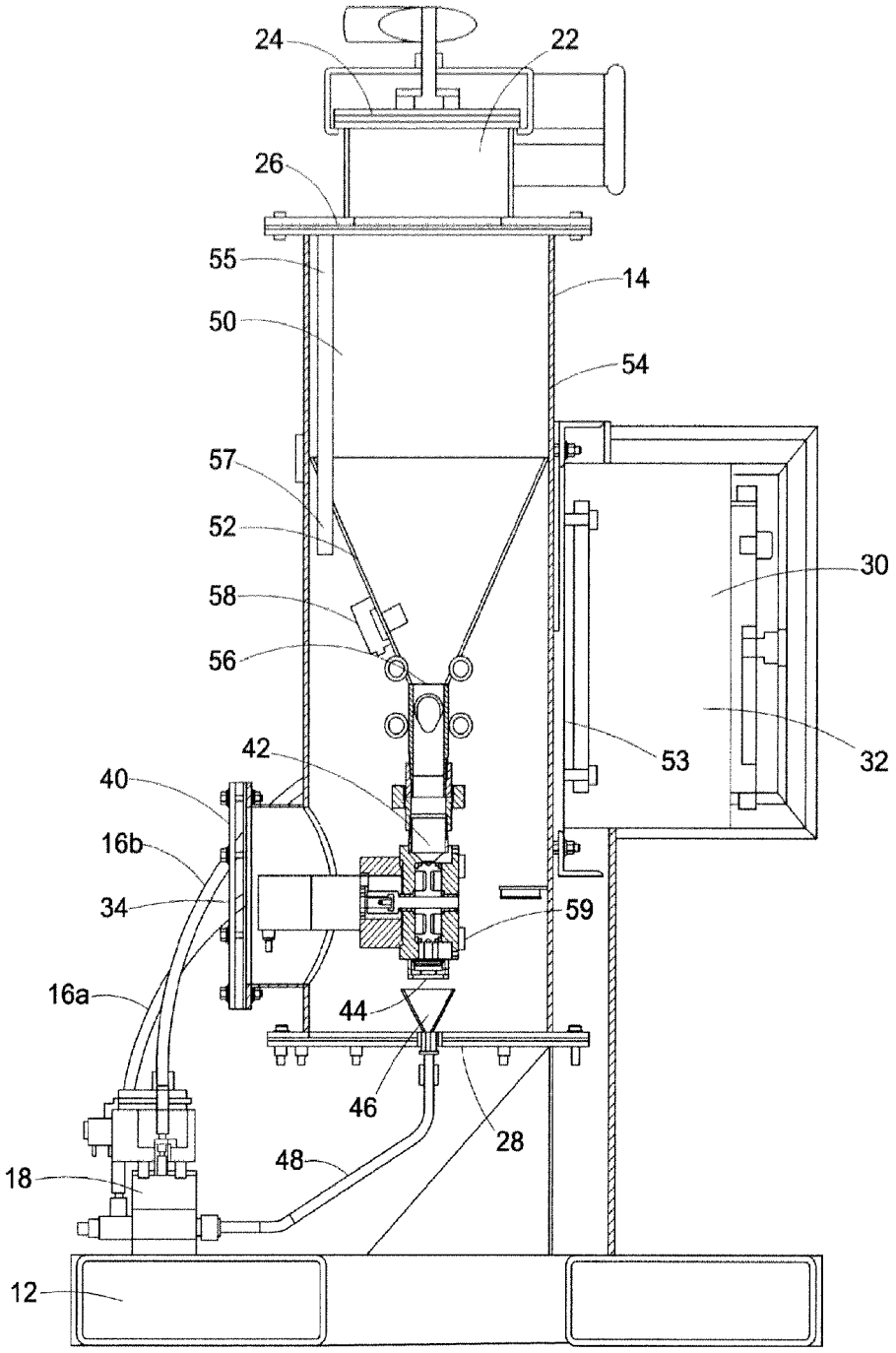
FIG. 2 is a cross sectional side view of the flux injector assembly.
Figure 3:
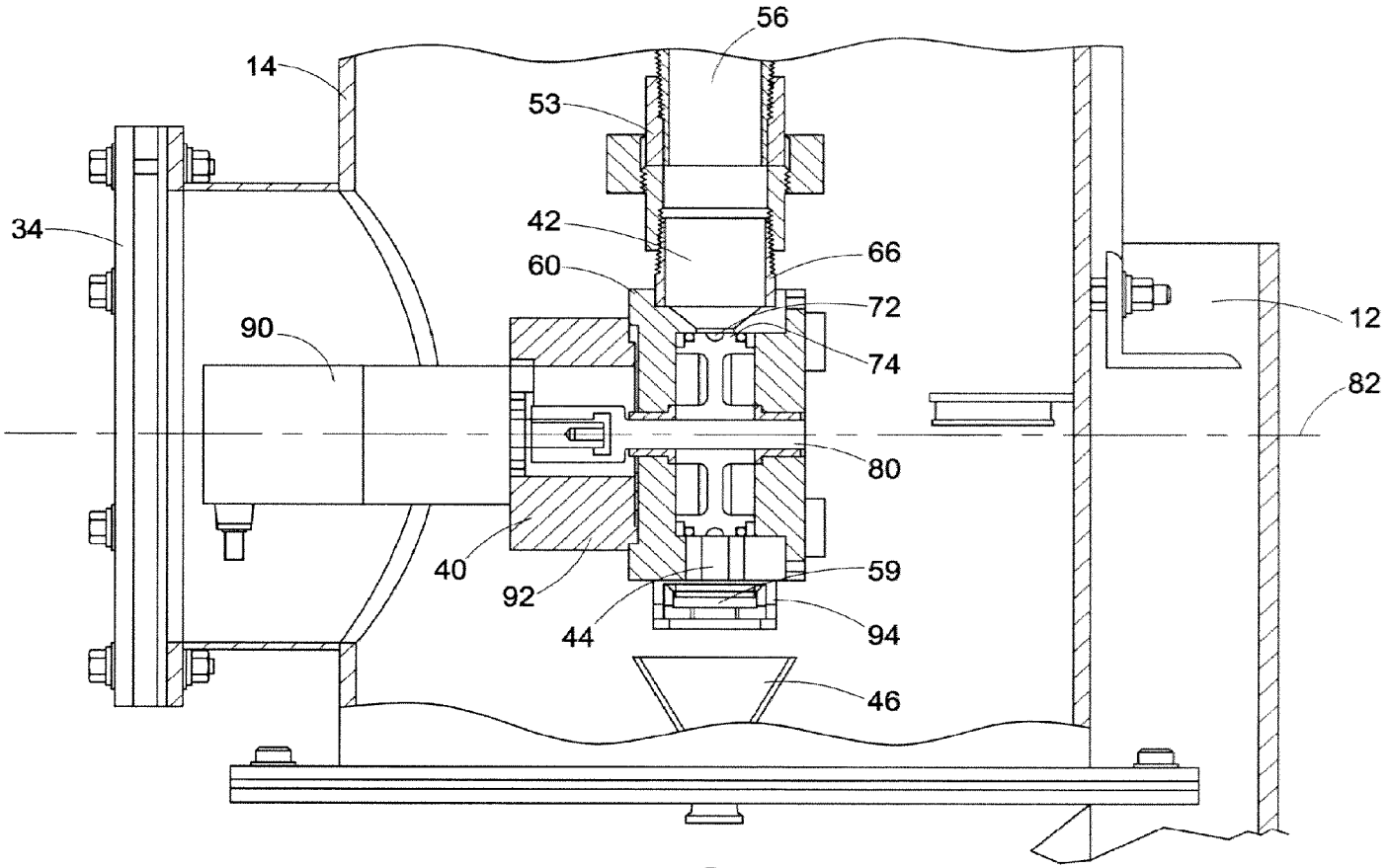
FIG. 3 is an enlarged cross sectional side view of the flux injector assembly.

With reference to FIG. 2, the tank 14 includes a feed mechanism 40 positioned within the pressurized tank 14 in communication with a storage tank 50. The feed mechanism 40 is operative to receive flux from the storage tank 50 at a feed inlet 42 and discharge a predetermined amount of flux from a feed outlet 44. The feed outlet 44 is spaced above a collector 46 positioned adjacent the second end 28 of the pressurized tank 14 to receive the predetermined amount of flux from the feed outlet 44. The collector 46 is in connected to a conduit 48 in a sealed manner to allow the transfer of flux from the tank 14 to the isolation mechanism 18 located on the structural base 12.

The storage tank 50 is positioned within the pressurized tank 14 adjacent the opening 22 at the first end 26 of the pressurized tank 14 such that additional flux can be provided through the opening 22. The cap 24 is provided at the opening 22 to provide a sealed fit to prevent moisture from accumulating within the tank 14 and to prevent excess flux and fumes associated with the flux to be released from within the storage tank 50. In one embodiment, the storage tank 50 includes a conical shaped base 52 that abuts an inner wall 54 of the tank 14. The storage tank 50 is defined by the area within the inner wall 54 between the first end 26 and the conical shaped base 52. The conical shaped base 52 is configured to allow flux to accumulate at a base aperture 56 that is in communication with the feed inlet 42 of the feeding mechanism 40. The storage tank 50 can include an equalization tube 55 in fluid communication with lower portion 57 of the pressurized tank 14 to allow pressure equalization while preventing unwanted flux transfer. In one embodiment, the storage tank 50 is adapted to contain approximately 100 pounds (45.36 kilograms) of flux.

The at least one sight window 34 allows a user to view the feed mechanism 40 as it operates within the pressurized tank 14. Additionally, hoses 16*a* and 16*b* are adapted to communicate between the isolation mechanism 18 and a gas/pneumatic controller (not shown). Hose 16*a* is a gas bypass line for inert gas flow wherein hose 16*b* is a pneumatic control supply line to actuate a valve in the isolation mechanism 18. The controller 30 is configured to control the level of pressure within the tank 14 and to identify and relay an alarm signal or audible sound to indicate an over pressurization condition of the tank 14. The over pressurization alarm signal can indicate the existence of shaft clogging within the system, downstream from the isolation mechanism 18, particularly in conduit 48.

The controller 30 is adapted to monitor and operate the flux injector assembly 10. The controller 30 can manipulate the feed mechanism 40, isolation mechanism 18 and adjust the level of pressure within the pressurized tank 14. The controller 30 manipulates the feed mechanism 40 to provide a predetermined amount of flux from the inlet 42 to the outlet 44 and will be more fully described herein. A first optic sensor 58 is provided adjacent the base aperture 56 to monitor the level of the flux in the storage tank 50. The optic sensor 58 sends a signal to the controller 30 that indicates the level of flux within the tank 50. Optionally, a second optic sensor 59 can be provided adjacent the feed outlet 44 of the feed mechanism 40 to communicate with the controller 30 to reflect that flux is being transferred through the feed outlet 44.

Figure 4:
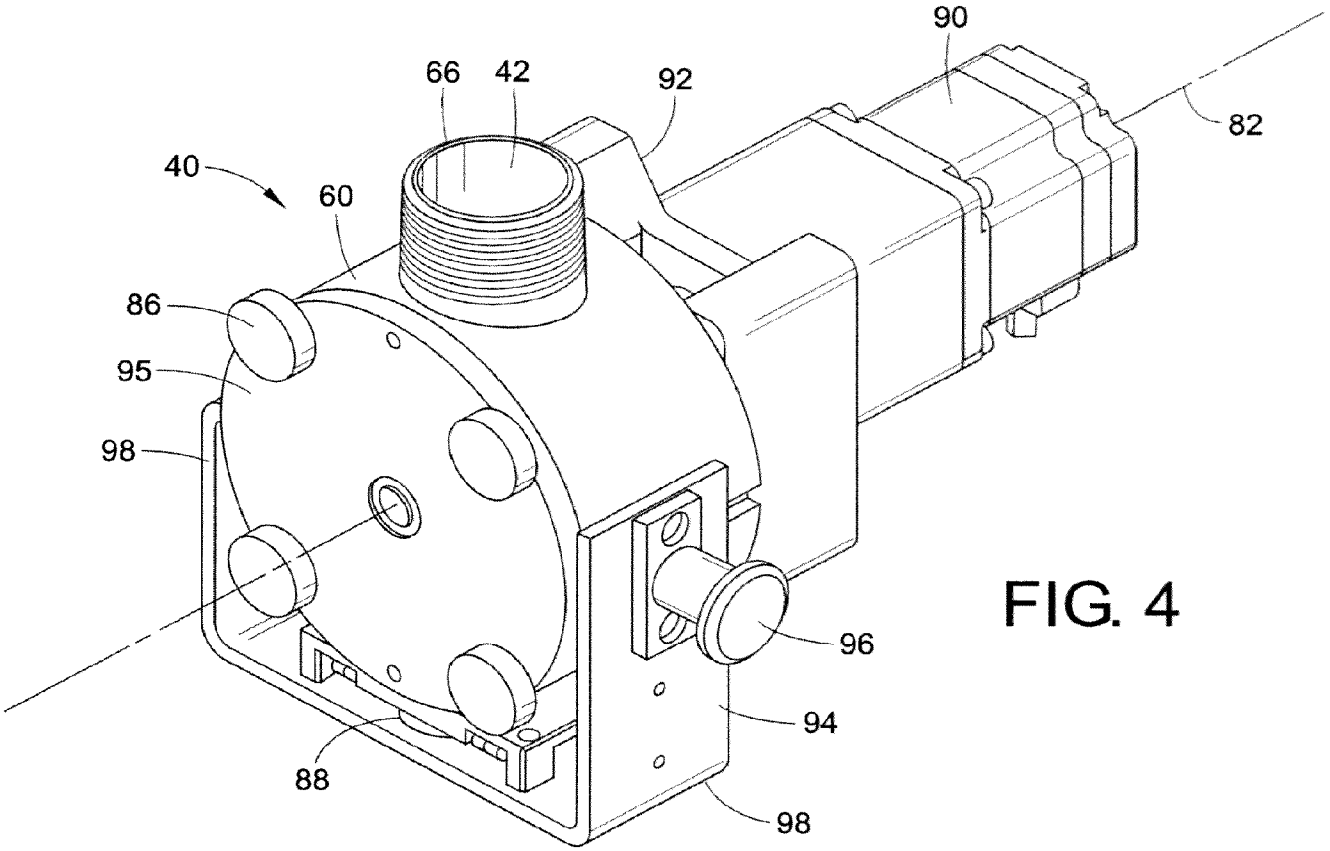
FIG. 4 is a perspective view of a feed mechanism of the flux injector assembly in accordance with the present disclosure.
Figure 5:
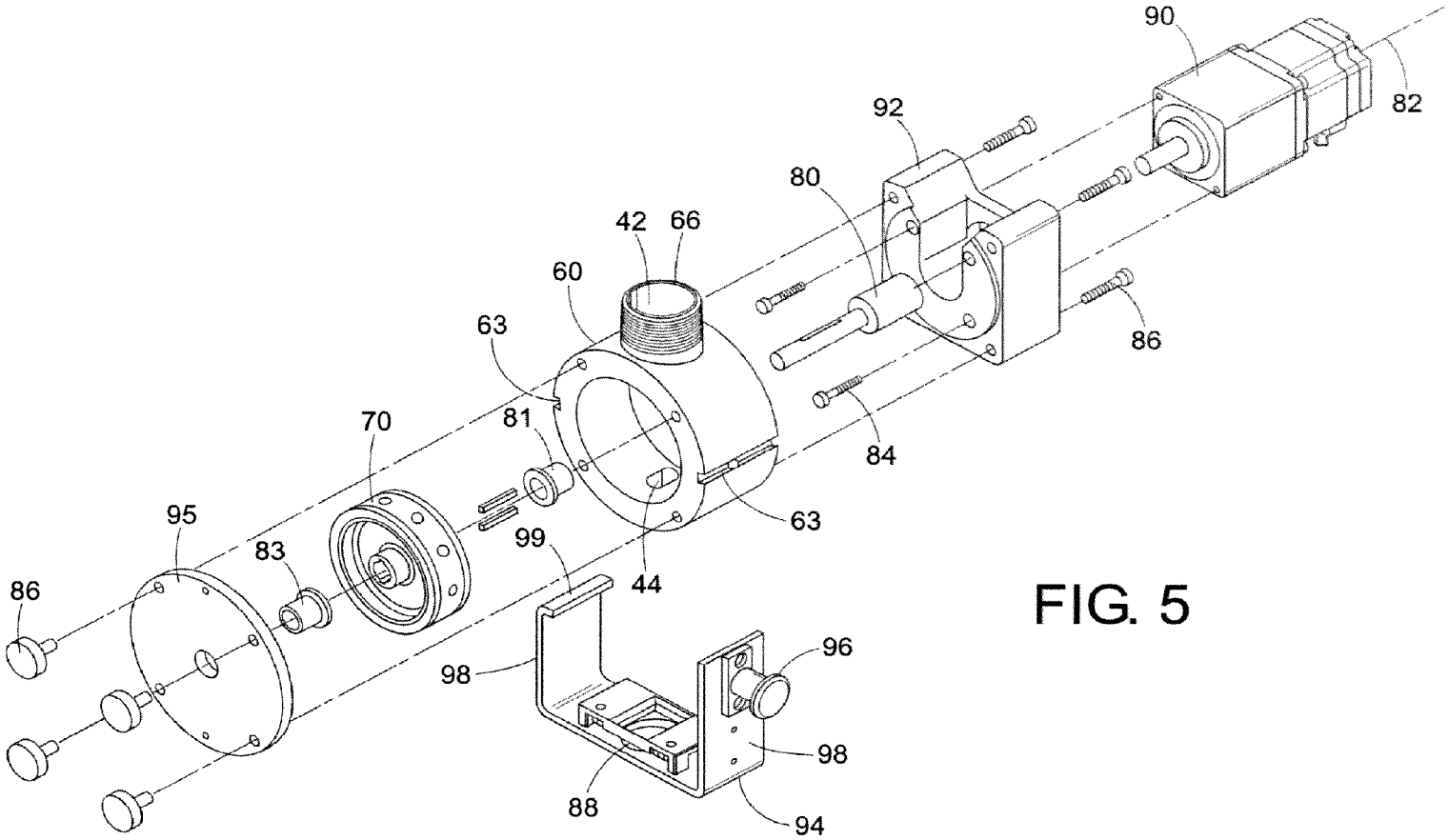
FIG. 5 is an exploded perspective view of the feed mechanism of the flux injector assembly.
Figure 6:
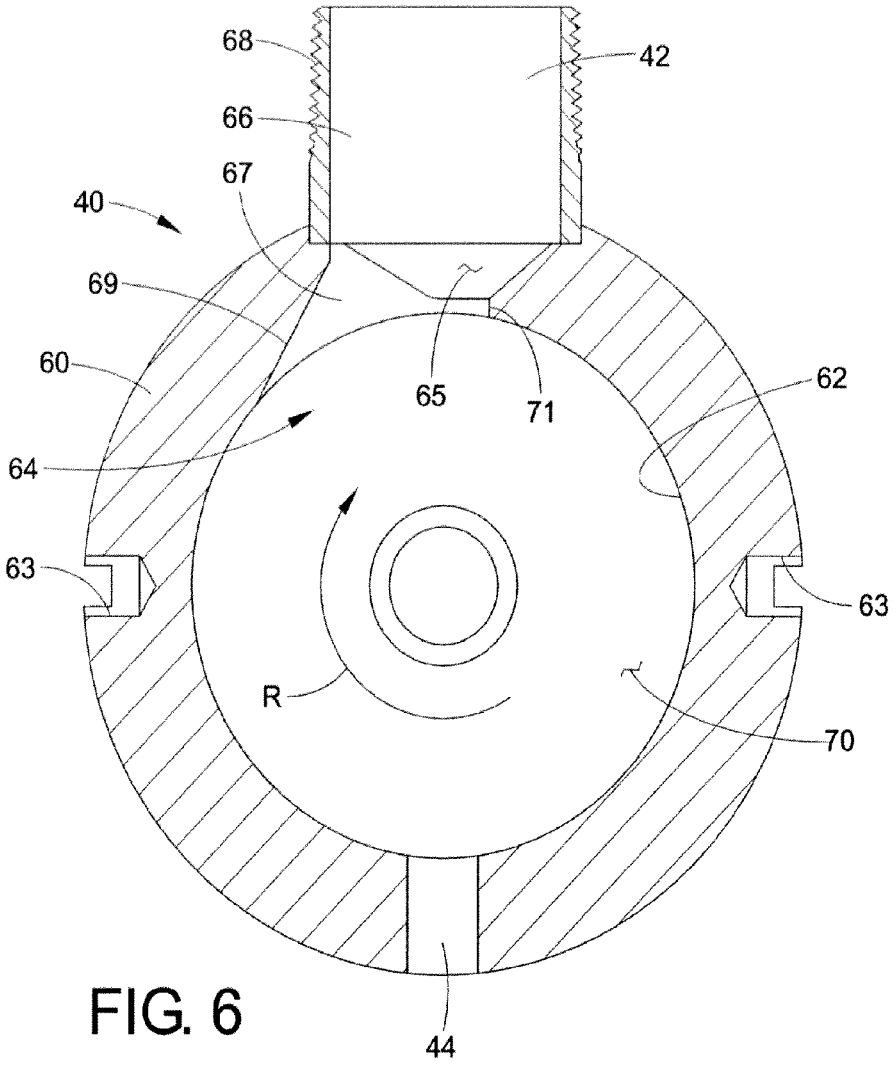
FIG. 6 is a front view of a housing of the feed mechanism of the flux injector assembly.
Figure 7:
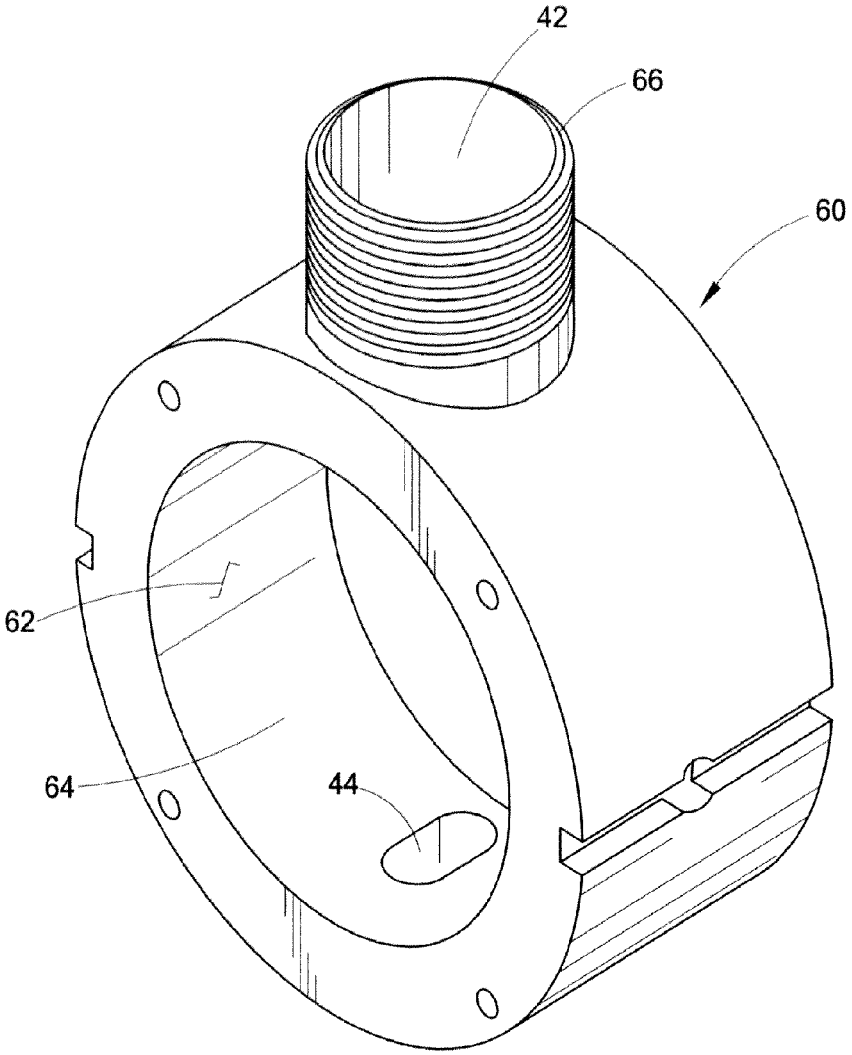
FIG. 7 is a perspective view of the housing of the feed mechanism of the flux injector assembly.

With reference to FIGS. 3 through 8, and in particular, FIG. 6, the feed mechanism 40 includes a housing 60 having an inner wall 62 defining a cavity 64 in communication with the feed inlet 42 and the feed outlet 44. The inner wall 62 of the housing 60 is generally circular and is adapted to receive a feed wheel 70. In one embodiment, the feed inlet 42 of the housing 60 is defined by an elongated hollow neck 66 with a threaded outer surface 68. The neck 66 is secured via coupling adapter 53 to the base aperture 56 (See FIGS. 2 and 3) of the storage tank 50 to receive flux at a receiving area 65 of the housing 60. The receiving area 65 includes a sloped surface that is angled to funnel flux through a transfer aperture 67 to the feed wheel 70. The transfer aperture 67 can have an undercut portion 69 at a leading edge opposite a sheering lip 71 of the inlet 42. The undercut portion 69 and sheering lip 71 are configured to prevent accumulation of flux between the storage tank 52 and the housing 60. In one embodiment, the transfer aperture 67 includes a generally oval shaped perimeter near the inlet 42 that expands outwardly along the undercut portion 69 with a generally rounded surface adjacent to the feel wheel 64.

The feed wheel 70 is positioned within the cavity 64 and is capable of being rotated in a direction R along a central rotational axis 82 by a rotor 80 in communication with a motor 90. (See FIGS. 3 and 5). The feed wheel 70 receives a predetermined amount of flux from the inlet 42 through the transfer aperture 67. In one embodiment (FIGS. 6 to 8), a plurality of notches 72 are positioned around a radial perimeter wall 74 of the feed wheel 70. As an example, each notch 72 may include a volume adapted to receive and transfer approximately one/tenth (1/10) of a gram of flux. The plurality of notches 72 are in rotational alignment with the transfer aperture 67 such that a measured or predetermined amount of flux is received at each notch 72 as the feed wheel 70 is rotated within the housing 60. The feed wheel 70 is configured with a fine tolerance between the radial perimeter wall 74 of the feed wheel 70 and the inner wall 62 of the housing 60 such that flux is prevented from entering the cavity 64 other than when transported by the notches 72. As the feed wheel 70 is rotated, flux is received at the notches 72 such that the sheering lip 71 acts to limit the flux received within each notch 72. In one embodiment, the sheering lip 71 has a clearance dimension from the feed wheel that is less than 0.05 inches (1.27 mm). In another embodiment, the clearance dimension is between 0.01 inches (0.25 mm) and 0.02 inches (0.51 mm) such that a preferred clearance dimension is approximately 0.016 inches (0.4 mm). The controller 30 is configured to manipulate the motor 90 to rotate the feed wheel 70 at a controlled rotational rate such that the amount of flux discharged from the housing 60 through the outlet 44 is known and controlled.

Figure 8:
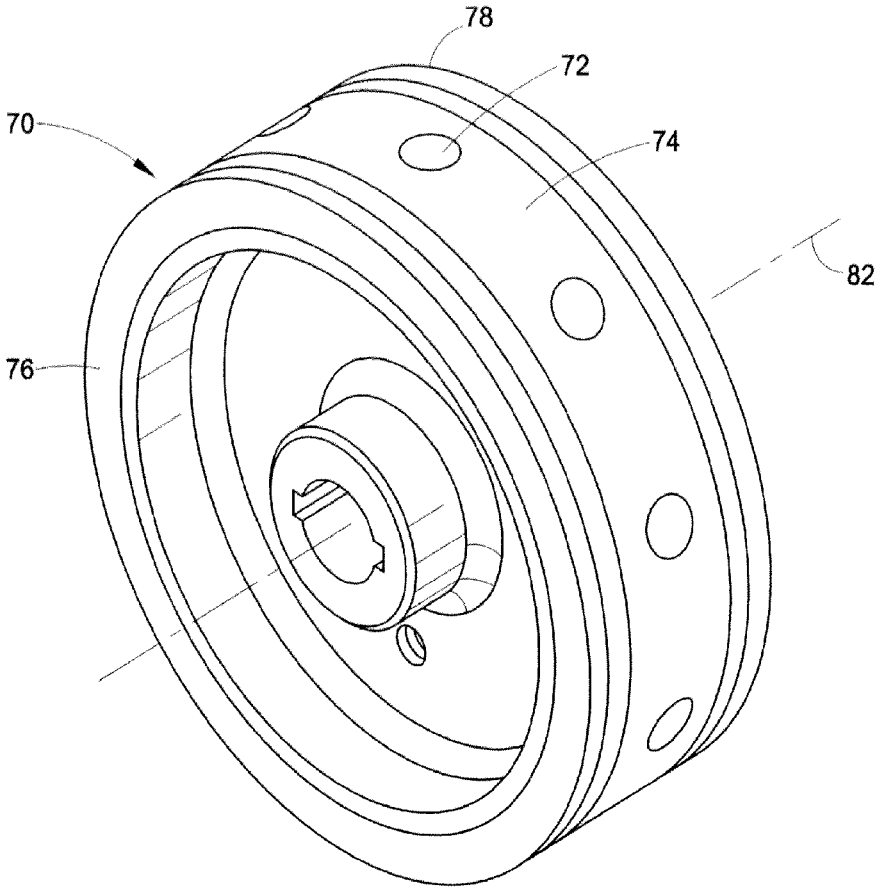
FIG. 8 is a perspective view of a feed wheel of the feed mechanism of the flux injector assembly.

With reference to FIG. 8, the feed wheel 70 receives the flux in the plurality of notches 72 from the feed inlet 42 and discharges the predetermined amount of flux through the feed outlet 44. The feed wheel 70 is provided with a first bearing 76 and a second bearing 78 at the radial perimeter wall 74 to assist the feed wheel 70 with rotational movement within the cavity 64 of the housing 60. The first and second bearings 76, 78 can be made from a frictional bearing material that snuggly aligns to the inner wall 62 and is adapted to prevent frictional wear as the feed wheel 70 is rotated within the housing 60.

With further reference to FIGS. 4 and 5, the feed motor 90 is supported within the pressurized tank 12. A first support bracket 92 is interposed between the housing 60 and the motor 90 along the central rotational axis. The first support bracket 92 includes an open portion aligned with the rotor 80 and adapted to support the rotational movement therein. The first support bracket has a set of motor fasteners 84 that is operable to rigidly attach to and support the motor 90 in position along the rotational axis 82. The feed wheel 70 is attached to the rotor 80 with a keyed arrangement to prevent rotational slippage. A first shaft bearing 81 and a second shaft bearing 83 are positioned at either side of the feed wheel 70 along the rotor 80 for a secured attachment. A second bracket 94 having a generally U-shape is attached to the housing 60 and configured for easy removal to allow access to the feed mechanism 40. The second bracket 94 includes an opening 88 aligned with the feed outlet 44 and a least one support rod 96 extending outwardly from an arm of the second bracket 94. The support rod 96 attaches to the feeder housing 60 positioned along the rotational axis 82. Optionally, the second bracket 94 can include a ridge 99 at an inner portion of the arm 98 that is aligned with a recess portion 63 along the housing 60. The ridge 99 is adapted to fit within the recess portion 63 and align the housing along the rotational axis 82 within the pressurized tank 14. A cover 95 is secured to the housing 60 to hold the feed wheel 70 within the cavity 64 along the central rotational axis 82. The housing 60 is attached to the cover 95 and the first bracket 92 by a set of housing fasteners 86.

In one embodiment the controller 30 is programmed to provide a threshold amount of flux to a pool of molten aluminum. The motor 90 rotates the feed wheel 70 at a controlled rotational rate such that a precise amount of flux is discharged from the outlet 44 and transferred through the collector 46 to the isolation mechanism 18. The rotations per minute of the feed wheel 70 are scalable by the controller 30 such that a change in rotational speed of the feed wheel 70 changes the amount of flux that is injected or discharged through the outlet 44. In one embodiment, the feed wheel 70 is provided with ten (10) notches 72 such that each notch 72 is adapted to hold one/tenth (1/10) gram of flux. Each full rotation of the feed wheel 70 would discharge one (1) gram of flux. Optionally, the volume of each notch 72 can be configured to include more or less flux. Further, any number of notches 72 can be located around the feed wheel 70. The controller 30 and feed mechanism 40 arrangement safely transfer an amount of flux that is less than or equal to a programmed or threshold amount as determined by the controller 30. Notably, as the notches 72 are rotated past the transfer aperture 67 of inlet 42, the amount of flux received in each notch 72 may be less than but not greater than the volume of each notch 72. This feature prevents the discharge of more flux than desired.

In one embodiment, the motor 90 includes a gear reducer such that one rotation of the rotor 80 is approximately equal to a partial rotation of the feed wheel 70. The partial rotation of the feed wheel 70 can be adapted to approximately equal the rotational distance for a single notch 72 holding flux to pass the feed outlet 44 and discharge flux from the single notch 72. The motor 90 can provide a signal to the controller to indicate every notch 72 that passes the feed outlet 44. Additionally, the motor 90 can be a step motor type with a fractional horsepower rating to drive or rotate the rotor 80 and the feed wheel 70 at a rotational rate as controlled by the controller 30.

In one embodiment, an inert gas such as argon or nitrogen is mixed with the predetermined amount of flux at the isolation mechanism 18. Alternatively, the inert gas can be mixed with the predetermined amount of flux within the pressurized tank 14 for example, at the collector 46. The isolation mechanism 18 is configured to communicate with a system of tubes (not shown) under pressure to introduce the flux/gas mixture into a pool of molten aluminum. Isolation mechanism 18 of the flux injector assembly 10 can be adapted to discharge flux as carried by the inert gas into a central hollow rotor (not shown) within the pool of aluminum. The hollow rotor is attached to an impeller such that rotation of the rotor distributes the flux into the molten aluminum through a plurality of apertures or fins within the impeller. This method efficiently degasses the molten aluminum such that hydrogen and other impurities are reduced from the molten aluminum. In one embodiment, this method causes an increase amount of hydrogen to rise to the top level of the molten aluminum where the hydrogen releases to the atmosphere or burns. The isolation mechanism 18 is easily detachable and attachable to the system of tubes and the hollow rotor such that the isolation mechanism 18 and control of pressure within the tank 14 are adapted to prevent molten material backflow from entering the pressurized hollow shaft (not shown) and connecting conduits, especially during the initial connection to the system of tubes.

According to yet another embodiment of the present disclosure, provided is a flux injector apparatus for distributing flux to a pool of molten metal. The flux material can include a mixture of magnesium chloride and potassium chloride. The flux is in a powdered or granular form having a grain size of 1-3 mm. The flux injector is controlled to discharge the flux at a rate between 2 grams per minute and 25 grams per minute. The flux is mixed with an inert gas such as argon at a flow rate between 20 standard cubic feet per hour (scfh) and 200 scfh.

The controller 30 is configured to modulate the pressure, meter the flux and monitor the amount of flux entering the injection system. The controller 30 can transmit an alarm signal or audible sound to identify if the first or second optic sensors 58, 59 have communicated to the controller 30 identifying that the flow of flux has stopped. The controller 30 can indicate the level of flux remaining within the pressurized tank 14 and includes gauges to sense and indicate the pressure within the tank 14 and alarms to identify a low or high pressure level. Notably, a high pressure level signal can indicate the existence of molten backflow or other clog existing within the system of tubes and central hollow rotor(not shown) that are in communication with the isolation mechanism 18. Additionally, it is beneficial to assemble the storage tank 50 with the feed mechanism 40 in a common pressurized tank 14 to allow for a metered and controlled distribution of flux along an interface that does not include a pressure differential. The metering of flux without a pressure differential interface reduces the need for sealed and pressurized transfer devices thereby decreasing cost and increasing consistency of operation of the flux injector assembly 10.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The Invention claimed is:

1. A flux injector apparatus adapted to distribute a predetermined amount of flux to an associated pool of molten aluminum, the apparatus comprising:

a tank containing flux;

a feed mechanism operative to discharge a predetermined amount of flux to an outlet;

a housing having an inner wall defining a cavity with an inlet and an outlet;

a feed wheel within the cavity and operative to receive a predetermined amount of flux from the inlet, translate the flux within the cavity and discharge the predetermined amount of flux through the outlet; and a controller.

2. The flux injector of claim 1 wherein the housing of the feed mechanism includes an undercut portion at a leading edge of the inlet to prevent blockage.

3. The flux injector of claim 1 wherein the feed wheel is associated with an inner wall of the housing with a clearance of less than 0.05 inches.

4. The flux injector of claim 1 wherein the feed wheel further includes a plurality of notches in selective rotational alignment with the inlet and the outlet for receiving and translating the predetermined amount of flux.

5. The flux injector of claim 4 wherein the predetermined amount of flux is approximately one/tenth (1/10) of a gram.

6. The flux injector of claim 4 wherein the controller rotates the feed wheel within the cavity of the housing at a controlled rate to transfer the predetermined amount of flux from the inlet to the outlet.

7. The flux injector of claim 1 wherein the tank contains a pressurized inert gas that is continually mixed with a predetermined amount flux.

8. The flux injector of claim 7 wherein the controller monitors the pressure in the tank, a level of flux in the tank and a status of the feed mechanism.

9. The flux injector of claim 8 wherein an optic sensor is provided to at least the outlet or the inlet to monitor a flow of flux.

10. The flux injector of claim 1 wherein a storage structure and feed mechanism are contained within a pressurized tank.

11. A method of introducing a predetermined amount of flux into a pool of molten aluminum, the method comprising:

providing flux to an inlet of a feed mechanism;

receiving a predetermined amount of flux at a notch of a feed wheel in the feed mechanism;

translating the flux to an outlet of the feed mechanism;

mixing an inert gas with the flux; and introducing a mixture of flux and inert gas into a pool of molten aluminum.

12. The method of claim 11 wherein the step of translating the flux includes rotating the feed wheel a controlled amount of rotations such that the amount of flux introduced to the molten aluminum is less than a predetermined threshold amount.

13. The method of claim 11, further comprising monitoring the amount of flux provided at the inlet of the feed mechanism.

14. The method of claim 11, further comprising monitoring the amount of flux mixed with the inert gas.

15. A flux injector apparatus for distributing flux to an associated pool of molten metal, the apparatus comprising a pressurized tank adapted to contain said flux, said apparatus including a window permitting inspection of a flow of the flux within said tank, a monitor to assess the pressure within said tank, the monitor in communication with a controller suited to increase and decrease said pressure, a feed wheel adjacent an outlet of said tank, said feed wheel receiving selected quantities of said flux and discharging said flux throughout said outlet.

16. The apparatus of claim 15 wherein said tank is pressurized to between about 2 and 10 psig.

17. The apparatus of claim 15 wherein said feed wheel includes a plurality of flux receiving notches.

18. The apparatus of claim 15 wherein a step motor drives said feed wheel.

19. A flux injector apparatus adapted to distribute a predetermined amount of flux to an associated pool of molten aluminum, the apparatus comprising:

a tank containing flux;

a feed mechanism operative to discharge a predetermined amount of flux to an outlet;

an optic sensor provided to at least an outlet or an inlet to monitor a flow of flux; and a controller.

* * * * *